US006902770B1

(12) United States Patent
Dulin et al.

(10) Patent No.: US 6,902,770 B1
(45) Date of Patent: Jun. 7, 2005

(54) METHOD OF TRANSPARENTIZING PAPER SUBTRATE AND PAPER ASSEMBLY WITH TRANSPARENTIZED WINDOW

(75) Inventors: Roger A. Dulin, Roanoke, VA (US); Robert A. DeMattia, Roanoke, VA (US); Bryan S. O'Mary, Germantown, TN (US); Michael Burris, Marietta, GA (US)

(73) Assignee: Infoseal L.L.C., Englewood, NJ (US)

( * ) Notice: Subject to any disclaimer, the term of this patent is extended or adjusted under 35 U.S.C. 154(b) by 257 days.

(21) Appl. No.: 09/843,085

(22) Filed: Apr. 27, 2001

(Under 37 CFR 1.47)

Related U.S. Application Data

(60) Provisional application No. 60/200,825, filed on Apr. 28, 2000.

(51) Int. Cl.[7] ..... B05D 1/40; B05D 3/06

(52) U.S. Cl. ..... 427/510; 427/161; 427/209; 427/382; 427/391; 162/135; 162/136; 162/201

(58) Field of Search ..... 427/510, 379, 427/381, 382, 389.9, 391, 392, 209, 161; 162/135, 136, 201

(56) References Cited

U.S. PATENT DOCUMENTS

| | | | | | |
|---|---|---|---|---|---|
| 2,108,804 | A | * | 2/1938 | Finzel et al. | 428/220 |
| 2,108,805 | A | * | 2/1938 | Finzel et al. | 427/161 |
| 2,108,806 | A | * | 2/1938 | Finzel et al. | 162/179 |
| 3,235,443 | A | * | 2/1966 | Greenman et al. | 162/135 |
| 3,813,261 | A | * | 5/1974 | Muller | 162/165 |
| 4,513,056 | A | * | 4/1985 | Vernois et al. | 428/482 |
| 4,526,803 | A | * | 7/1985 | White | 427/468 |
| 5,418,205 | A | | 5/1995 | Mehta et al. | 503/206 |
| 5,849,398 | A | * | 12/1998 | Petrosky | 427/161 |
| 6,103,355 | A | | 8/2000 | Mehta | 428/211 |
| 6,143,120 | A | | 11/2000 | Mehta et al. | 156/272.2 |

FOREIGN PATENT DOCUMENTS

| | | | |
|---|---|---|---|
| FR | 1399903 | * | 5/1965 |

* cited by examiner

*Primary Examiner*—Erma Cameron
(74) *Attorney, Agent, or Firm*—Mintz, Levin, Cohn, Ferris, Glovsky and Popeo, P.C.

(57) ABSTRACT

The invention provides an improved method of transparentizing a paper substrate to produce a translucent area or "window" through which information and data are displayed. The method of the invention applies a transparentizing material to a preselected application site of the paper substrate, and exposes the transparentizing material to heat for a predetermined period of time to help facilitate penetration of the transparentizing material into the paper substrate and prevent migration of the transparentizing material from the application site. The rate of penetration of the transparentizing material into the paper substrate reduces the time and increases the efficiency of the transparentizing process. The invention also provides a paper substrate and a one-piece paper assembly in which a translucent area or "window" is formed according to the method of the invention.

21 Claims, 13 Drawing Sheets

METHOD OF TRANSPARENTIZING PAPER SUBTRATE AND PAPER ASSEMBLY WITH TRANSPARENTIZED WINDOW

CLAIM OF PRIORITY TO PREVIOUS APPLICATIONS

The present application claims priority under 37 C.F.R. §119(e) to U.S. provisional patent application Ser. No. 60/200,825, filed on Apr. 28, 2000, incorporated herein by reference.

FIELD OF THE INVENTION

The invention is generally directed to a method of producing a translucent portion in a paper substrate. More particularly, the invention is directed to a method for transparentizing a preselected area of a paper substrate to produce a translucent "window" for display of information and data. The invention is also directed to a paper substrate or assembly including a translucent area or "window" produced according to the method of the invention.

BACKGROUND OF THE INVENTION

Various types of envelopes, mailers, and paper assemblies typically include an opening or "window" through which information and data are displayed. The methods of constructing a "window" in an envelope or mailer, for instance, are well known in the art and include die-cutting a portion of a paper substrate to form a hole or "window." The die-cut window may remain uncovered or, alternatively, may be covered with a patch of a translucent or transparent material that has sufficient clarity to allow information and data to be displayed through the window when the paper substrate is assembled into an envelope, mailer or other paper assembly. The translucent or transparent material typically used to construct the patch is a durable material, such as glassine. Glassine patches are disposed over a back surface of a die-cut window and adhered to an inner surface of a envelope, mailer or paper assembly. Glassine and other types of patches used to form prior art windows, however, produce finished pieces that do not exhibit good lay flat characteristics, since such patches are not integral and contiguous with the paper substrate with which such pieces are constructed. In effect, prior art window patches do not allow envelopes, mailers or other paper assemblies to lay flat or stack evenly once assembled. Uneven stacks often cause feeding difficulties as a single envelope, mailer or paper assembly is fed from an uneven stack into printing and other processing equipment. Uneven stacks reduce the number of finished pieces that can be contained by trays feeding processing equipment. In addition, processing equipment often becomes jammed due to feeding from uneven stacks, thereby increasing downtime and reducing production throughput.

Prior art chemical processes of producing a translucent or transparent window in a paper substrate provide an alternative to open or patched windows and typically include application of a transparentizing material to a paper substrate. Such a prior art method of transparentizing is disclosed in U.S. Pat. No. 5,418,205, which provides a method of transparentizing whereby an area of a paper substrate is prepared or processed prior to application of a transparentizing material. According to this method, the area of the paper substrate is made thinner than the remainder of the paper substrate in order to enhance penetration of the transparentizing material into the paper substrate once applied. The area can be made thinner by a variety of well-known means, including mechanical grinding and compressing or crushing the area to a desired thickness. However, such preparatory steps constitute additional time in the transparentizing process, as well as additional processing in the overall production of envelopes, mailers and other paper assemblies.

Therefore, it is desirable to provide a method of transparentizing that eliminates or at least substantially reduces the number of preparatory or other process steps required, while producing a translucent area or "window" with sufficient clarity and reflectance to display information and data. In addition, it is also desirable to provide a paper substrate or assembly with a translucent area or "window" that allows finished pieces to exhibit good lay flat characteristics.

SUMMARY OF THE INVENTION

A first embodiment of the present invention is directed to a method of transparentizing a portion of a paper substrate, wherein the method comprises providing a paper substrate; preselecting an application site on the paper substrate to be transparentized; providing a transparentizing material; applying the transparentizing material to a first surface of the preselected application site; providing a first heat source; exposing the first surface of the application site to heat supplied by the first heat source for a period of time; providing a first curing agent; and exposing the first surface of the application site to the first curing agent for a period of time. The method of the invention further comprises providing sufficient time between exposure of the application site to heat and exposure of the application site to the curing agent to allow penetration of the transparentizing material into the paper substrate.

A first aspect of a second embodiment of the method of the invention comprises applying transparentizing material to a second surface of the preselected application site. The method comprises providing a second heat source and exposing the second surface of the application site to heat provided by the second heat source for a period of time. The method further includes providing a second curing agent and exposing the second surface of the application site to the second curing agent for period of time. The first and second surfaces of the application site may be exposed to heat or the curing agent simultaneously, wherein both the first and second surfaces are exposed to either heat or the curing agent at the same time. Alternatively, the first surface of the application site may be initially exposed to heat and thereafter the second surface is exposed to heat with a similar order of exposure to the curing agent.

A second aspect of a second embodiment of the method of the invention comprises heating the transparentizing material prior to applying the transparentizing material to the application site. A third aspect of the second embodiment of the method of the invention comprises embossing a perimeter around the preselected application site to prevent migration of the transparentizing material from the application site once applied.

A third embodiment of the method of the invention further comprises controlling a rate of conveyance of the paper substrate to adjust the period of time the application site is exposed to heat, wherein the rate of conveyance of the paper substrate is from about 20 meters per minute to about 250 meters per minute. The method further comprises controlling a rate of conveyance of the paper substrate to adjust the period of time the application site is exposed to the first curing agent, wherein the rate of conveyance of the paper substrate is a range of from about 20 meters per minute to about 250 meters per minute.

A fourth embodiment of the invention provides a paper substrate comprising a single ply of suitable paper with a top edge, a bottom edge, a first side edge and a second side edge to define a sheet; and a translucent area, the translucent area being formed in the sheet by a method of transparentizing including: preselecting an application site on the sheet to be transparentized; providing a transparentizing material; applying the transparentizing material to a first surface of the preselected application site; providing a first heat source; exposing the first surface of the application site to heat supplied by the first heat source for a period of time; providing a first curing agent; and exposing the first surface of the application site to the first curing agent for a period of time.

A first aspect of a fifth embodiment of the invention provides a one-piece paper assembly comprising a single ply of suitable paper with a top edge, a bottom edge, a first side edge and a second side edge to define a sheet; and a translucent area, the translucent area being formed in the sheet by a method of transparentizing including: preselecting an application site on the panel to be transparentized; providing a transparentizing material; applying the transparentizing material to a first surface of the preselected application site; providing a first heat source; exposing the first surface of the application site to heat supplied by the first heat source for a period of time; providing a first curing agent; and exposing the first surface of the application site to the first curing agent for a period of time. The one-piece paper assembly further comprises one or more fold lines traversing a width of the sheet to form one or more panel sections; a line of weakening disposed longitudinally along the first side edge of the sheet to define a first marginal strip between the line of weakening and the first side edge, and line of weakening disposed longitudinally along the second side edge to define a second marginal strip between the line of weakening and the second side edge; a line of adhesive or cohesive disposed longitudinally along each of the first and second marginal strips; and a line of adhesive or cohesive disposed along the top edge of the sheet.

A second aspect of the fifth embodiment of the invention provides the one-piece paper assembly further comprising a feed strip with a plurality of pin-holes attached to each of the first and second side edges of the sheet.

A third aspect of the fifth embodiment of the invention provides the one-piece paper assembly further comprising an insert incorporated with the sheet, the insert coupled to the sheet by adhesive between the insert and the sheet and having lines of weakening extending longitudinally along the first and second side edges coincident with the lines of weakening of the sheet.

A fourth aspect of the fifth embodiment of the invention provides the one-piece paper assembly further comprising a return envelope incorporated with the sheet, the return envelope adhered to the sheet by adhesive or cohesive disposed just inside the lines of weakening and the bottom edge of the sheet to form a pocket.

A fifth aspect of the fifth embodiment of the invention provides the one-piece paper assembly with the translucent area being capable of receiving printing from a laser-printer or other printing device such that information or data are directly printed on the translucent area in reverse font imaging.

A sixth aspect of the fifth embodiment of the invention provides the one-piece paper assembly further comprising the translucent area located at a predetermined position in the assembly such that when the assembly is traversely folded, the translucent area is on an outer surface of the assembly and information and data printed on an inner surface of the assembly are displayed through the translucent area.

BRIEF DESCRIPTION OF THE DRAWINGS

For a better understanding of the invention, reference is made to the drawings which are incorporated herein by reference, and in which.

DETAILED DESCRIPTION OF THE INVENTION

Illustrative embodiments of the invention described below are directed to a method of transparentizing to produce a translucent area or "window" in a paper substrate used to construct an envelope, mailer or other paper assembly. Those skilled in the art will appreciate that the embodiments of the invention are not limited to the method of producing a translucent area or "window" in an envelope, mailer or other paper assembly, but may include the method of transparentizing any paper substrate used in any paper application that requires translucent portions of various size and shape to display information and data. The invention also provides a paper substrate or assembly including a translucent area or "window" produced according to the method of the invention. Embodiments of the invention will be described with reference to FIGS. 1–14*b* which are presented for the purpose of illustrating embodiments and are not intended to limit the scope of the invention.

The method of transparentizing a paper substrate according to the invention is an improved and efficient process that may be incorporated into an in-line production process of producing envelopes, mailers or other paper assemblies. The transparentizing method comprises process steps of applying heat to an area of a paper substrate to which a transparentizing material has been applied in order to help facilitate the penetration of the transparentizing material into the paper substrate. The application of heat to the transparentizing material according to the method of the invention increases a rate of penetration of the transparentizing material into the paper substrate and prevents migration of the transparentizing material from the site of application. Hence, the method of the invention is an improved transparentizing method that increases the efficiency with which paper substrates are transparentized.

Figure 1:
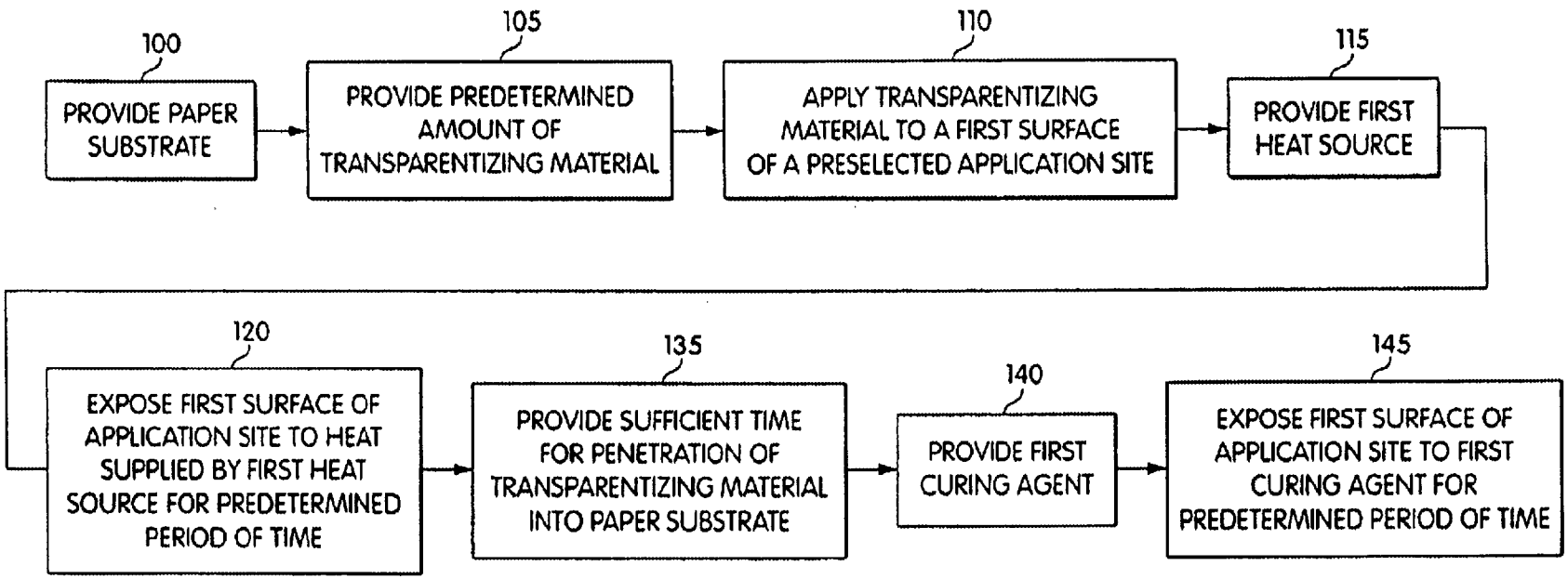
FIG. 1 is a flow diagram of a first embodiment of a method of transparentizing according to the invention.

Referring to FIG. 1, a first embodiment of the method of the invention comprises providing a paper substrate constructed of laser printer-compatible paper or other paper suitable for transparentizing (100), such as, although not limited to, paper stock of a weight ranging from about 24 pounds to about 28 pounds. In one embodiment, a paper substrate suitable for transparentizing may include a paper substrate constructed of heavy weight paper stock, such as, although not limited to, paper stock of about 28 pounds. Such heavy weight paper stock may be compressed or processed prior to transparentizing in order to reduce its thickness from about 0.005 inch to about 0.00425 inch. Use of heavy weight paper stock helps to facilitate easy handling and smooth feeding of the paper stock into an in-line production process or other processing equipment.

The method of the first embodiment further comprises providing a predetermined amount of transparentizing material (105), and applying the transparentizing material to a first surface of a preselected application site on the paper substrate (110). The preselected application site corresponds to a desired location of the transparentized "window" on a resulting mailer or paper assembly. The method comprises providing a suitable first heat source to deliver heat to the paper substrate (115), and exposing the first surface of the application site to heat supplied by the first heat source for a predetermined period of time (120). Exposure of the application site to heat helps to facilitate rapid penetration of the transparentizing material into the paper substrate. The method further comprises providing a predetermined period of time between a process step of exposing the application site to heat and other subsequent process steps to allow the transparentizing material to penetrate the paper substrate (135). After the application site is exposed to heat, the method comprises providing a first curing agent to cure the application site (140), and exposing the first surface of the application site to the curing agent for a predetermined period of time to set or fix the transparentized material at the application site (145). Curing the application site helps to prevent migration of the transparentizing material from the application site and to arrest further penetration of the transparentized material into the Art Unit 1762 paper substrate.

Figure 2:
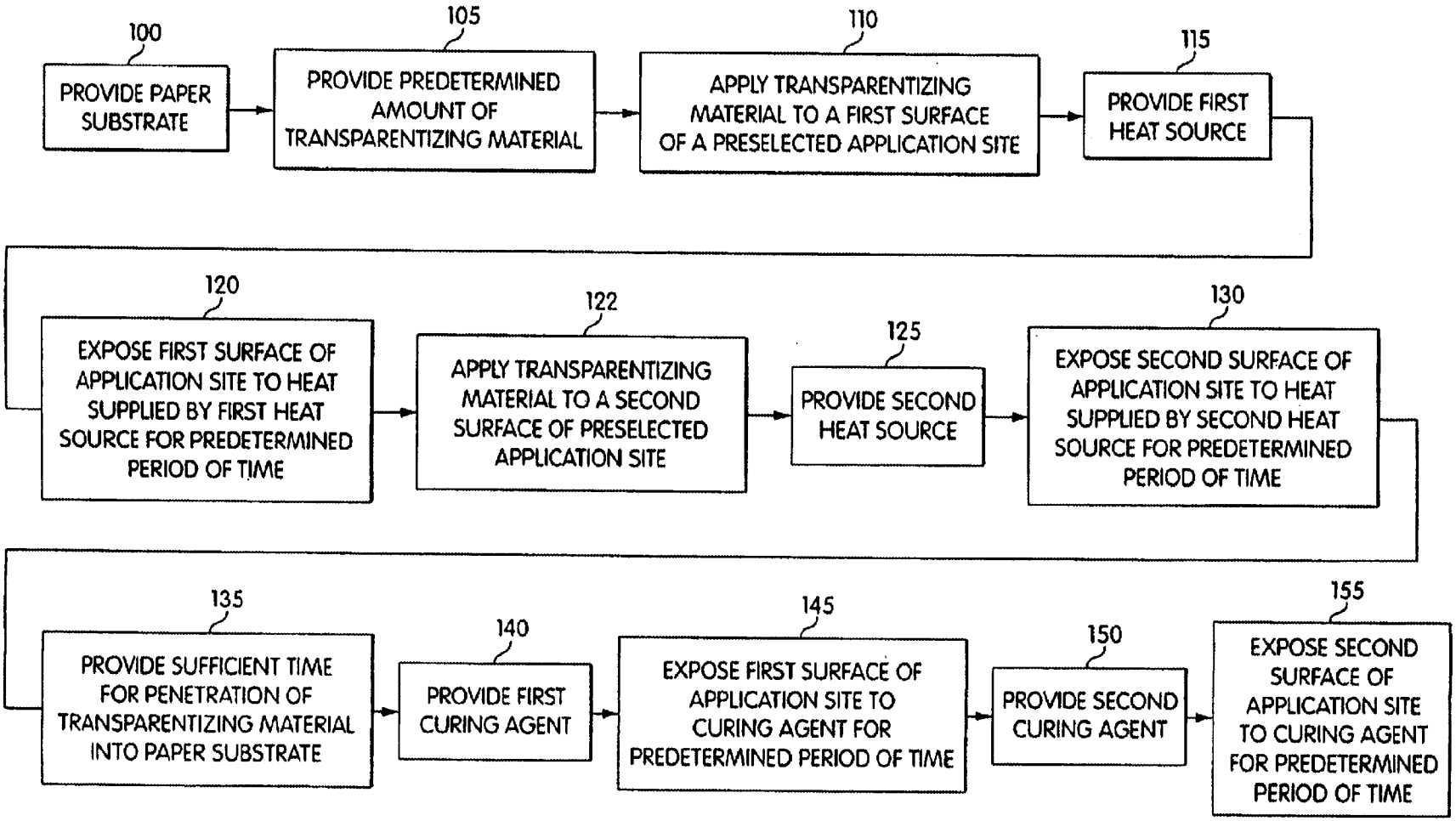
FIG. 2 is a flow diagram of a first aspect of a second embodiment of the method of transparentizing according to the invention.

Referring to FIG. 2, a first aspect of a second embodiment of the method of the invention comprises applying transparentizing material to a second surface of the preselected application site (122). A second heat source is provided (125) and the second surface of the application site is exposed to heat supplied by the second heat source for a second predetermined period of time (130). A second curing agent is also provided (150) and the second surface of the application site is exposed to the second curing for a second predetermined period of time (155).

Figure 3:
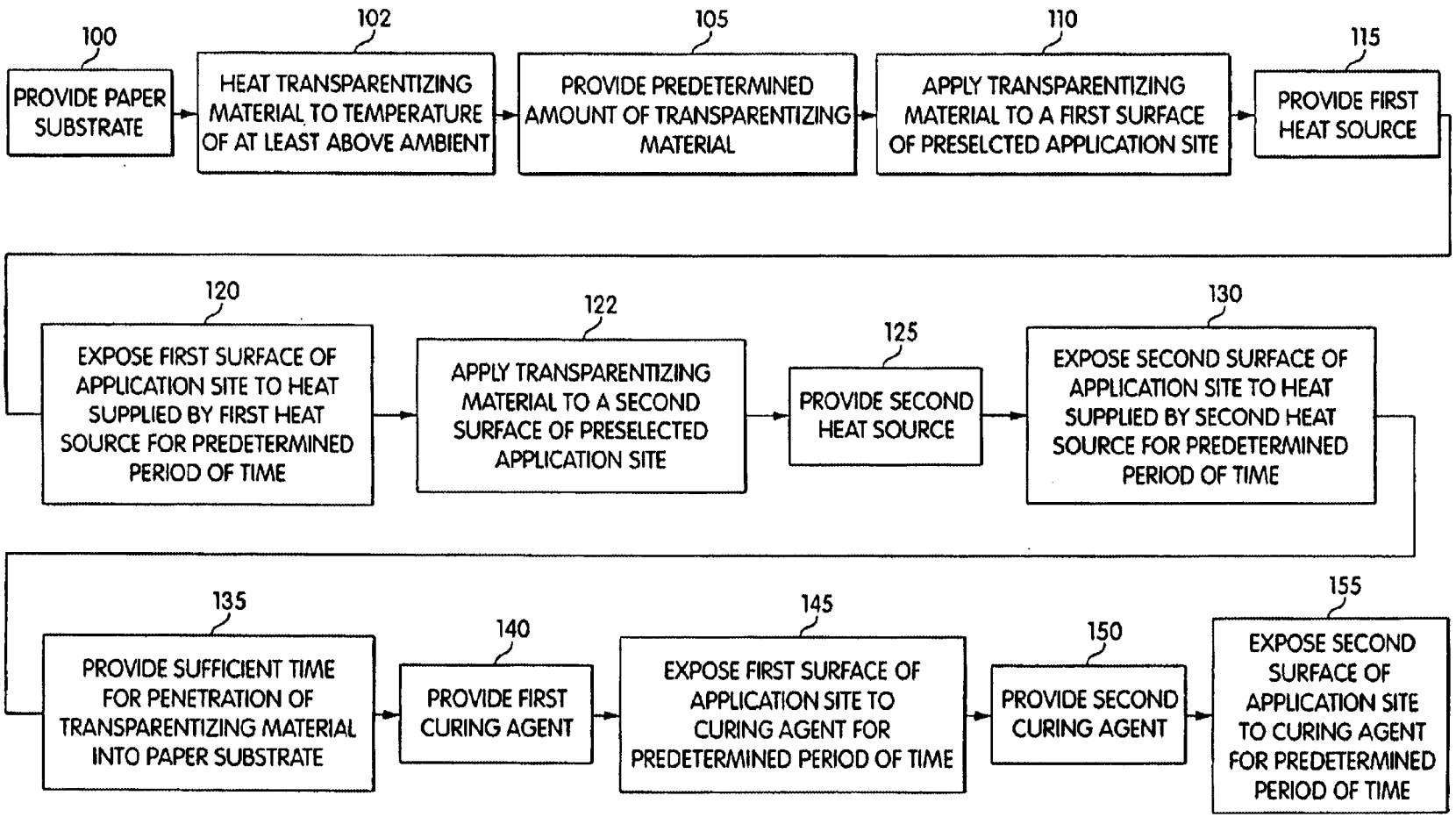
FIG. 3 is a flow diagram of a second aspect of the second embodiment.

Referring to FIG. 3, a second aspect of the second embodiment of the method further comprises heating the transparentizing material (102) to a temperature of at least above ambient temperature prior to application to the application site. Heating the transparentizing material helps to facilitate penetration of the transparentizing material into the paper substrate when exposed to heat. Thus, a rate of penetration of the transparentizing material into the paper substrate may be further increased by heating the transparentizing material prior to its application, as well as by heating the transparentizing material once applied to the application.

Figure 4:
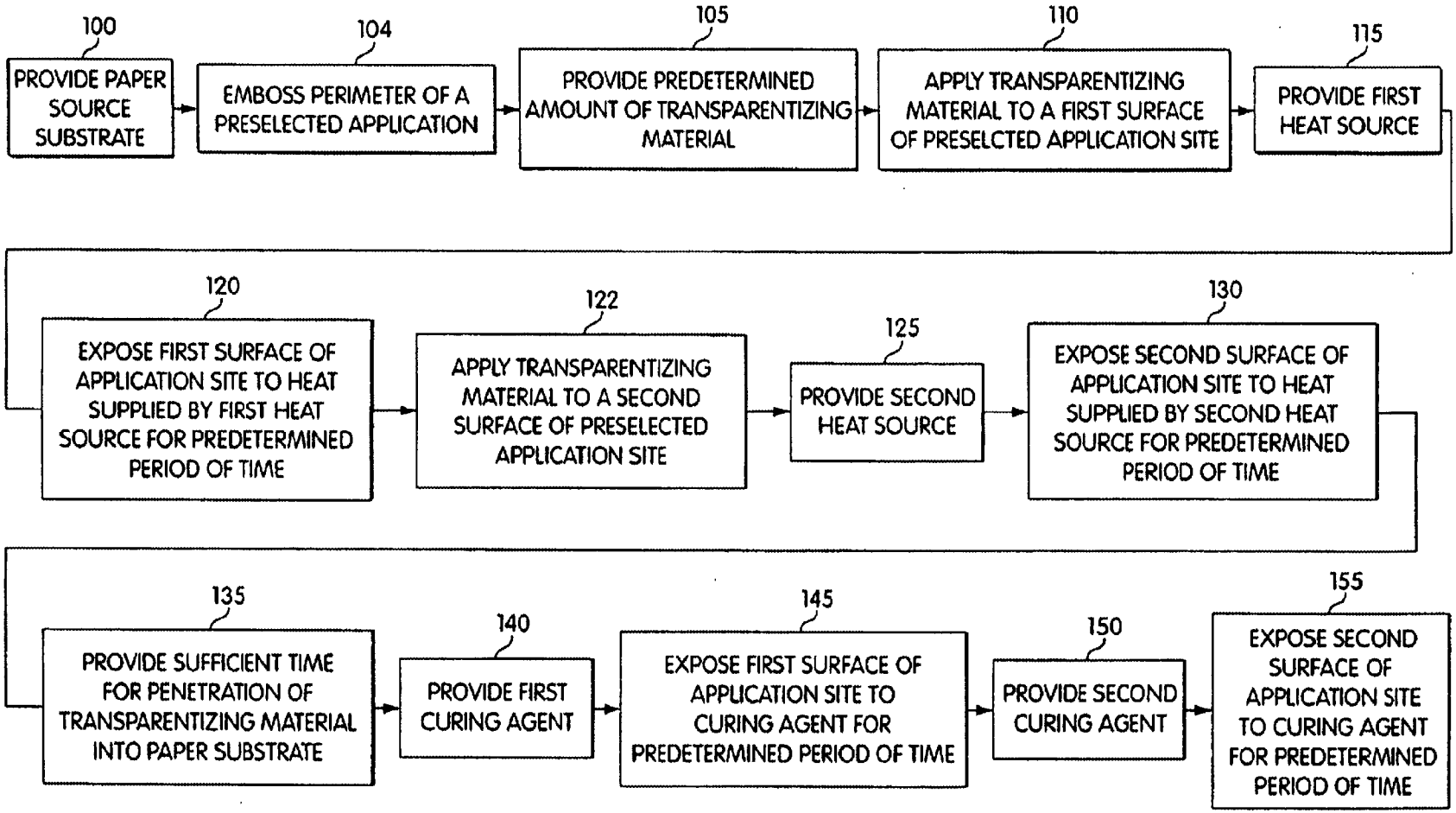
FIG. 4 is a flow diagram of a third aspect of the second embodiment.
Figure 5:
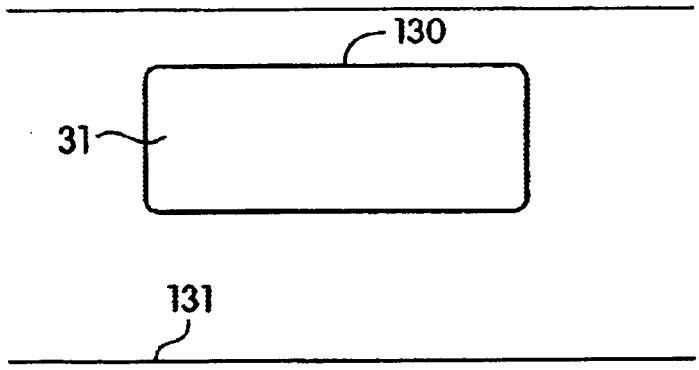
FIG. 5 is a top plan view of an effect of embossing according to the third aspect of the second embodiment.
Figure 6:
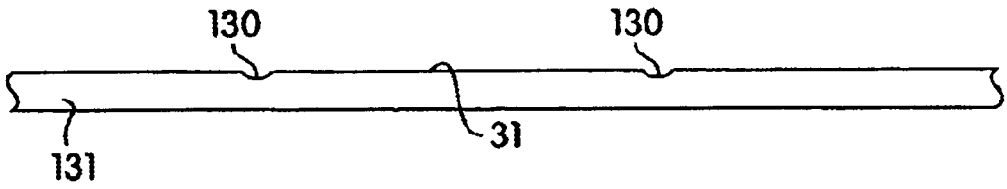
FIG. 6 is a cross-sectional view of the effect of embossing.

Referring to FIGS. 4–6, a third aspect of the second embodiment of the method comprises embossing a perimeter of the preselected application site with a stamp embosser or similar embossing device prior to application of the transparentizing material (104). As shown in FIG. 5, the embosser imprints by impact an embossed line 130 around a perimeter of the preselected application site 31 in a paper substrate 131. The preselected application site 31 corresponds to a desired location of the translucent portion or "window" in a resulting envelope, mailer or paper assembly. As shown in FIG. 6, the embossed line 130 defines the perimeter of the preselected application site 31 and includes a depressed line that serves to help prevent migration of the transparentizing material beyond the application site 31 once applied.

A feature and advantage of the method of the invention includes the rapid penetration of the transparentizing material into the paper substrate upon exposure to heat. The rate of penetration of the transparentizing material into the paper substrate eliminates or at least substantially reduces the opportunity for migration of the transparentizing material such that the transparentized material remains fixed at the application site. In addition, the rapid penetration of the transparentizing material into the paper substrate substantially reduces processing time, thereby increasing the efficiency of transparentizing according to the method of the invention. The rate of penetration of the transparentizing material may be controlled by adjusting the period of time during which the application site is exposed to heat, as supplied by the first heat source, and, optionally, by the second heat source. The period of time of heat exposure may be controlled by adjusting a rate at which the paper substrate is conveyed past the first and second heat sources. The period of time of heat exposure may also be controlled by adjusting a distance the paper substrate must be conveyed from one process step to another, such as, for instance, the distance between the first heat source and the second heat source, or the distance between exposure to heat and exposure to the curing agent In addition, the rate of penetration of the transparentizing material into the paper substrate helps to increase the overall efficiency of manufacturing envelopes, mailers and other paper assemblies from the transparentized paper substrate by reducing production time and increasing the rate of throughput. In particular, the rapid penetration of the transparentizing material into the paper substrate eliminates or at least substantially reduces the need to prepare or treat the application site of the paper substrate prior to application of the transparentizing material, thereby eliminating or at least substantially reducing the number of process steps. Preparatory steps to prepare the application site, such as mechanical grinding, compressing or crushing a paper substrate, are often required by prior art methods of transparentizing in order to facilitate penetration and to prevent migration of the transparentizing material from the application site, as well as to achieve a sufficient and acceptable reflectance and OCR characteristics of the resulting "window". Such preparatory steps are not required according to the transparentizing method of the invention.

Figure 7:
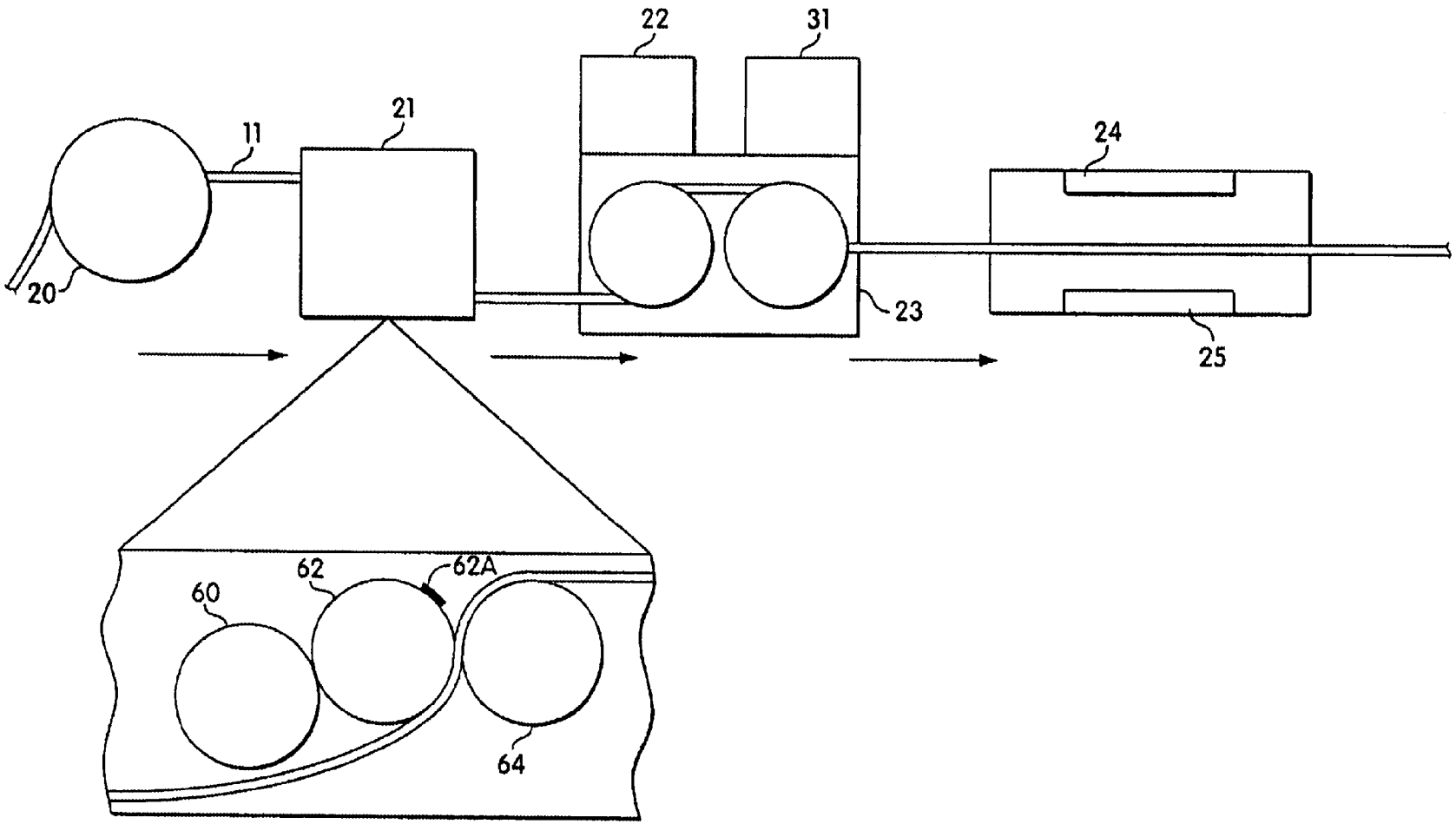
FIG. 7 is an schematic illustration of a third embodiment of the method of transparentizing according to the invention.

Referring to FIG. 7, a third embodiment of the invention comprises a method of transparentizing a paper substrate incorporated with an in-line production process of manufacturing a multiple of envelopes, mailers or other paper assemblies. As shown in FIG. 7, the paper substrate of the second embodiment comprises a web 11 of laser-compatible paper or other paper suitable for transparentizing. The web 11 is unwound from a roller 20, whereby the web 11 is fed through a series of conveyance rollers 21. A dispensed quantity of a transparentizing material is initially applied to a surface of a first or anilox roller 60. The anilox roller 60 applies the transparentizing material to a surface of a second or application roller 62. The application roller 62 has a circumference substantially equivalent to, or some multiple of, a length of the resulting mailer or paper assembly. A third roller, an anvil roller 64, facilitates movement of the web 11 through the series of conveyance rollers 21.

The application roller 62 includes a pattern 62*a*, such as, although not limited to, a neoprene rubber pattern. The neoprene rubber pattern 62*a* is attached to a surface of the application roller 62. The neoprene rubber pattern 62*a* serves as an applicator to apply the transparentizing material to an application site on a first surface of the web 11 as the web is fed through the application roller 62. The neoprene rubber pattern 62*a* is located at a specific position on the application roller 62 that corresponds to a desired application site and ultimate location of the translucent "window" on a resulting mailer or paper assembly. The neoprene rubber pattern 62*a* is shaped substantially similar to an elongated rectangle that is analogous to an address "window" of a mailer, although the method of the invention is not limited to any particular size or shape of the neoprene rubber pattern 62*a* or other applicator used to apply the transparentizing material to the application site.

As the web 11 is fed through the application roller 62, the neoprene rubber pattern 62*a* receives an application of the transparentizing material from the anvil roller 60 and subsequently the application site on the first surface of the web 11 receives an application of the transparentizing material from the neoprene rubber pattern 62*a*. A reservoir or pot contains the transparentizing material, which meters and dispenses the transparentizing material onto a surface of the anilox roller 60. The method of dispensing and applying the transparentizing material to the surface of the anilox roller 60 is not relevant to the invention and any method well known in the art to meter and dispense the transparentizing material may be used.

The transparentizing material used in the method of the invention may be any transparentizing material known in the art, such as, although not limited to, the transparentizing materials available under the trademark UVERCRYL™ available from UCB Chemical of Smyrna, Ga.

The amount of transparentizing material applied to the application site on the web 11 is controlled by determining the clarity of the transparentized portion desired and achieved during production. Typically, an off-line reflectance meter is used to measure the clarity of the transparentized portion to determine, based upon such measurement, whether the amount of the transparentized material applied to the web 11 should be adjusted. An object of the method of the invention is to achieve a transparentized area that meets the specification of the U.S. Postal Service for reflectance and OCR characteristics.

After the transparentizing material is applied to the application site, the web 11 is conveyed for a predetermined period of time past at least a first heat source 22 to expose the transparentized application site to heat. The predetermined period of time is achieved by controlling and adjusting the rate of conveyance of the web 11 past the first heat source 22. The rate of conveyance of the web 11 past the first heat source 22 is from about 20 meters per minute to about 250 meters per minute, and preferably about 70 meters per minute. The first heat source 22 may include any suitable heat source, such as, although not limited to, an infra-red heater. In one embodiment, the in-line production process may include a second heat source 31 to expose the transparentized application site to heat for a second predetermined period of time according to the method of the invention. Similarly, the second heat source 31 may include any suitable heat source, such as, although not limited to an infra-red heater.

After conveyance of the web 11 past the first heat source 22, and, optionally, past the second heat source 31, the web 11 is fed through a series of web rollers 23 or, as referred to in the art, festooned through the series of web rollers 23. Festooning is a step often incorporated with the in-line production process of producing mailers and other paper assemblies to provide a desired period of time between individual process steps. Festooning may be used with the transparentizing method of the invention between the steps of exposing the application site of the web 11 to heat and subsequent process steps in order to provide sufficient time for penetration of the transparentizing material into the web 11.

Subsequent to festooning, the web 11 is conveyed for a predetermined period of time past a first curing agent 24 to expose the transparentized application site to the first curing agent 24 to cure or set the transparentizing material. The first curing agent 24 may include, although is not limited to, a suitable ultraviolet lamp (UV) positioned above the web 11 to provide ultraviolet radiation to the first surface of the web 11. The ultraviolet radiation acts as a curing agent to set or fix the transparentizing material in the application site, thereby arresting penetration of the transparentizing material into the web 11. The predetermined period of time during which the web 11 is conveyed past the first UV lamp 24 is achieved by controlling and adjusting the rate of conveyance of the web 11. The rate of conveyance of the web 11 past the first curing agent 24 is from about 20 meters per minute to about 250 meters per minute, and preferably about 70 meters per minute.

In one embodiment, a second curing agent 25 may be provided and include, although is not limited to, a second suitable ultraviolet lamp (UV) positioned below the web 11 to provide ultraviolet radiation to a second bottom surface of the web 11 to similarly set or fix the transparentizing material. As shown in FIG. 2, the web 11 may be simultaneously conveyed between two UV lamps 24, 25 with the first UV lamp 24 above the web 11 and the second UV lamp 25 positioned opposite and parallel to the first UV lamp below the web 11.

As described above, an off-line reflectance meter is used during the transparentizing method according to the invention to determine if the clarity or reflectance of the transparentized area is sufficient to allow information and data to be viewed through the translucent portion of the resulting mailer or other paper assembly and to meet the U.S. Postal Service specifications.

Figure 8A:
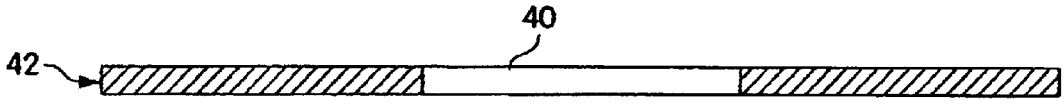
FIG. 8*a* is a cross-sectional view of a fourth embodiment of the invention providing a paper substrate including a translucent area transparentized according to the method of the invention.
Figure 8B:
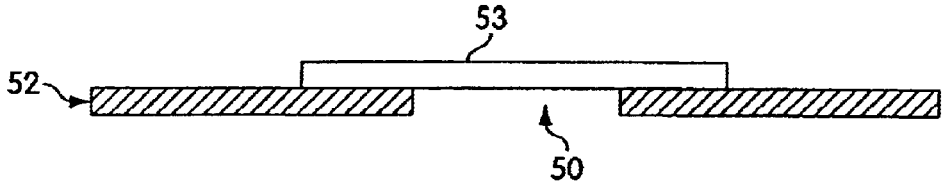
FIG. 8*b* is a cross-sectional view of a prior art paper substrate including a prior art "window".

Referring to FIG. 8*a*–8*b*, a cross-sectional view illustrates a fourth embodiment of the invention providing a paper substrate 42 comprising a translucent area 40 transparentized according to the method of the invention, as described herein. The translucent area 40 may serve as a translucent "window" in a mailer or other paper assembly to allow viewing of information and data printed in the mailer or paper assembly. The paper substrate 42 is suitable for use in any paper application that requires a paper assembly to be constructed and configured with at least one translucent portion or "window". The paper substrate is used, for example, to assemble mailers, envelopes, packaging, order forms, mailer inserts, return envelope inserts, and other paper assemblies.

The translucent area 40 is integral with the paper substrate 42 and continuous with at least a top surface of the paper substrate 45, thereby creating good lay flat characteristics and preserving a substantially planar surface of the paper substrate 42. In contrast, as shown in FIG. 7*b*, a cross-sectional view of a paper substrate 52 illustrates a prior art "window" comprising an open area 50 die cut from the paper substrate 52 with a glassine patch 53 attached to the paper substrate 52 to cover the open area 50. The glassine patch 53 of the prior art "window" is neither integral the paper substrate 52 nor contiguous with a top surface of the paper substrate 52 and, therefore, does not provide a flat surface of the paper substrate 52. When such a paper substrate 52 is used to produce a multiple of mailers or other paper assemblies, the mailers and paper assemblies do not exhibit good lay flat characteristics, resulting in uneven stacks of finished mailers and paper assemblies. The paper substrate 42 with the translucent "window" 40 produced according to the transparentizing method of the invention eliminates the use of glassine or similar types of patches.

Figure 9:
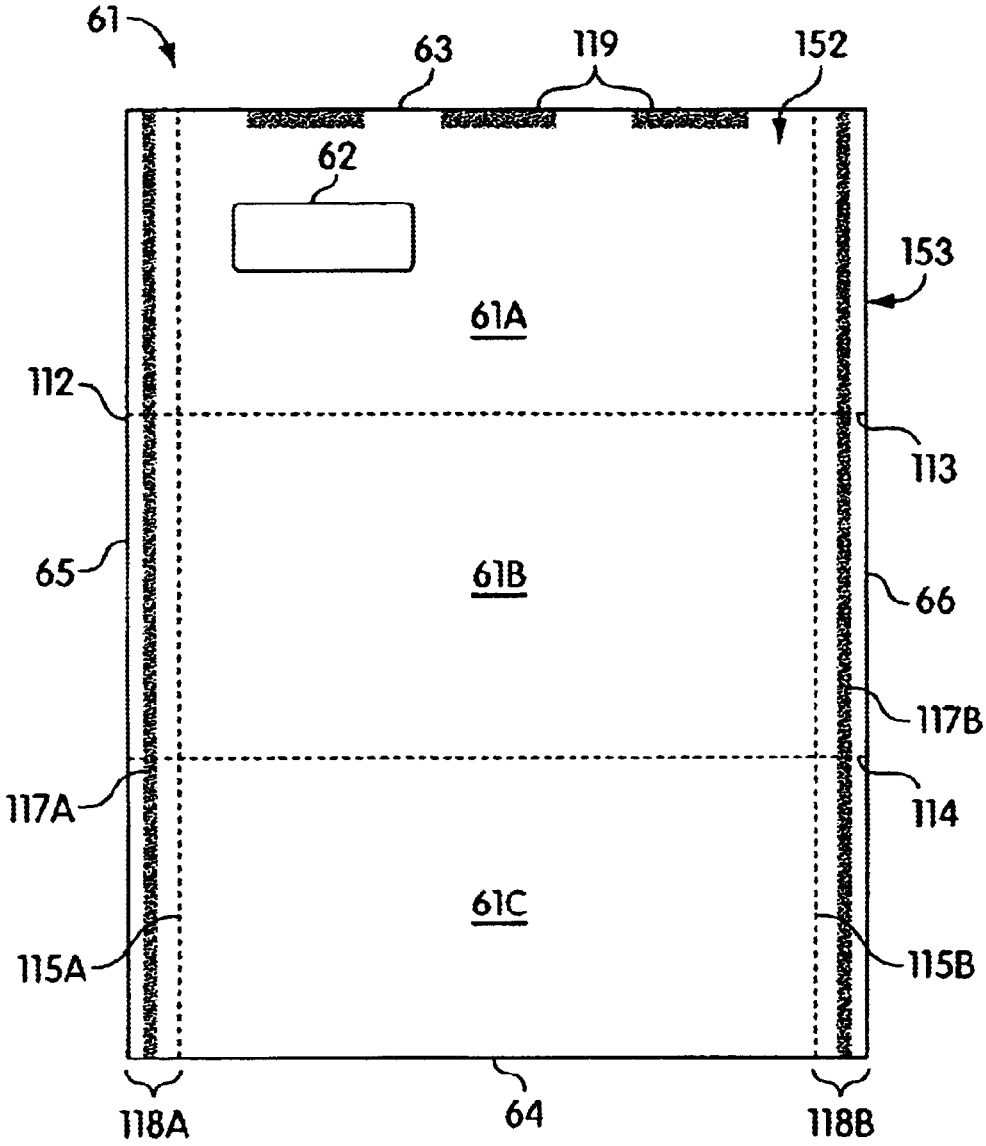
FIG. 9 is a top plan view of a first aspect of a fifth embodiment of the invention providing a one-piece paper assembly including a translucent area transparentized according to the method of the invention.

Referring to FIG. 9, a top plan view illustrates a first aspect of a fifth embodiment of the invention providing a one-piece paper assembly 61 comprising at least one translucent area or "window" 62 transparentized according to the method of the invention, as described herein. The one-piece assembly 61 comprises at least one ply or sheet 112 of laser printer-compatible paper or other suitable paper for transparentizing with a front surface 152 and a back surface 153 (not shown). The one-piece assembly 61 has a top edge 63, a bottom edge 64, a first side edge 65 and a second side edge 66 to define the one-piece paper assembly 61 as an elongated panel. At least one fold line 113, such as, although not limited to, a line of perforations, traverses the width of the assembly to enable the assembly to fold into at least two panels with each panel facing substantially adjacent to the other panel. As shown in FIG. 9, the assembly 61 includes a second fold line 114 traversing a width of the assembly 61 to fold it into three panels 61*a*, 61*b*, 61*c* to achieve a three-panel or C-fold type of configuration. Fold lines 113, 114 may be spaced approximately equidistant from each other to create two or more panels of approximately equal overall dimensions. In one embodiment, additional fold lines may be incorporated into the assembly 61 to enable it to be traversely folded into several panels relative to a length of the assembly 61.

The assembly 61 includes lines of weakening 115*a*, 115*b* including, although not limited to, lines of perforations, extending longitudinally along the first side edge 65 and along the second side edge 66. The lines of weakening 115*a*, 11 5*b* and the side edges 65, 66 define removable marginal strips 118*a*, 118*b*. Lines of adhesive or cohesive 117*a*, 11 7*b* are disposed between the lines of weakening 115*a*, 115*b* and the side edges 65, 66 and extend longitudinally along the first and the second side edges 65, 66. A suitable adhesive or cohesive may include, although is not limited to, applied, pressure-seal and remoistenable adhesives or cohesives. Alternatively, in one embodiment of the invention, the marginal strips 118*a*, 118*b* are adhesive-free and the assembly is secured by other mechanisms to form the assembly 61.

In addition to the lines of adhesive or cohesive 117*a*, 117*b* extending longitudinally along each side edge 65, 66, adhesive or cohesive may be disposed across the width of the one-piece assembly 61 along a vertical edge, such as the top edge 63. Adhesive or cohesive may be disposed as a line of adhesive or cohesive or, as shown in FIG. 9, as an array of adhesive or cohesive "dots" 119 disposed intermittently across the width of the assembly.

When the assembly 61 is folded in a C-fold configuration, each panel is adhered to an adjacent panel by the longitudinal lines of adhesive or cohesive 117*a*, 117*b* along the marginal strips 118*a*, 118*b*. To unfold the assembly, the marginal strips 118*a*, 118*b* are removed or torn from the assembly along the lines of weakening 115*a*, 115*b* to release and unfold the panels 61*a*, 61*b*, 61*c*.

Figure 10:
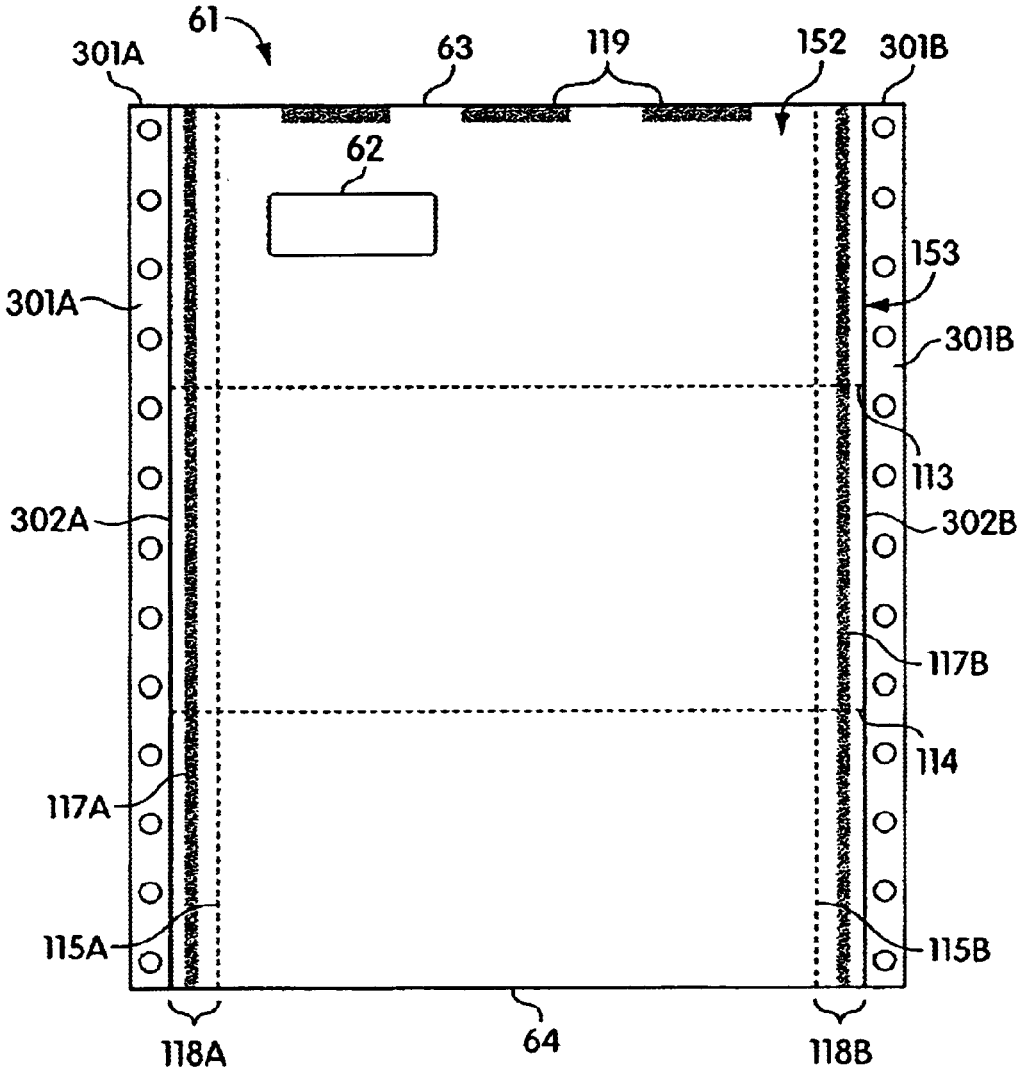
FIG. 10 is a top plan view of a second aspect of the fifth embodiment.

Referring to FIG. 10, a top plan view illustrates a second aspect of the fifth embodiment of the invention providing the one-piece assembly 61 comprising the translucent window 62 and a pair of feed strips 301*a*, 301*b* having a plurality of pin-holes disposed longitudinally along the first and second side edges 65, 66 of the assembly 61. The feed strips 301*a*, 301*b* are attached to the first and second side edges 65, 66 of the assembly 61, as shown in FIG. 10. In one embodiment, the first and second side edges may comprise lines of weakening, such as, although not limited to, lines of perforations 302*a*, 302*b* which serve to detach the feed strips 301*a*, 301*b* from the assembly 61. The pin-holes help to facilitate formation of a multiple of one-piece assemblies from a continuous web of a paper substrate fed through processing equipment.

Figure 11:
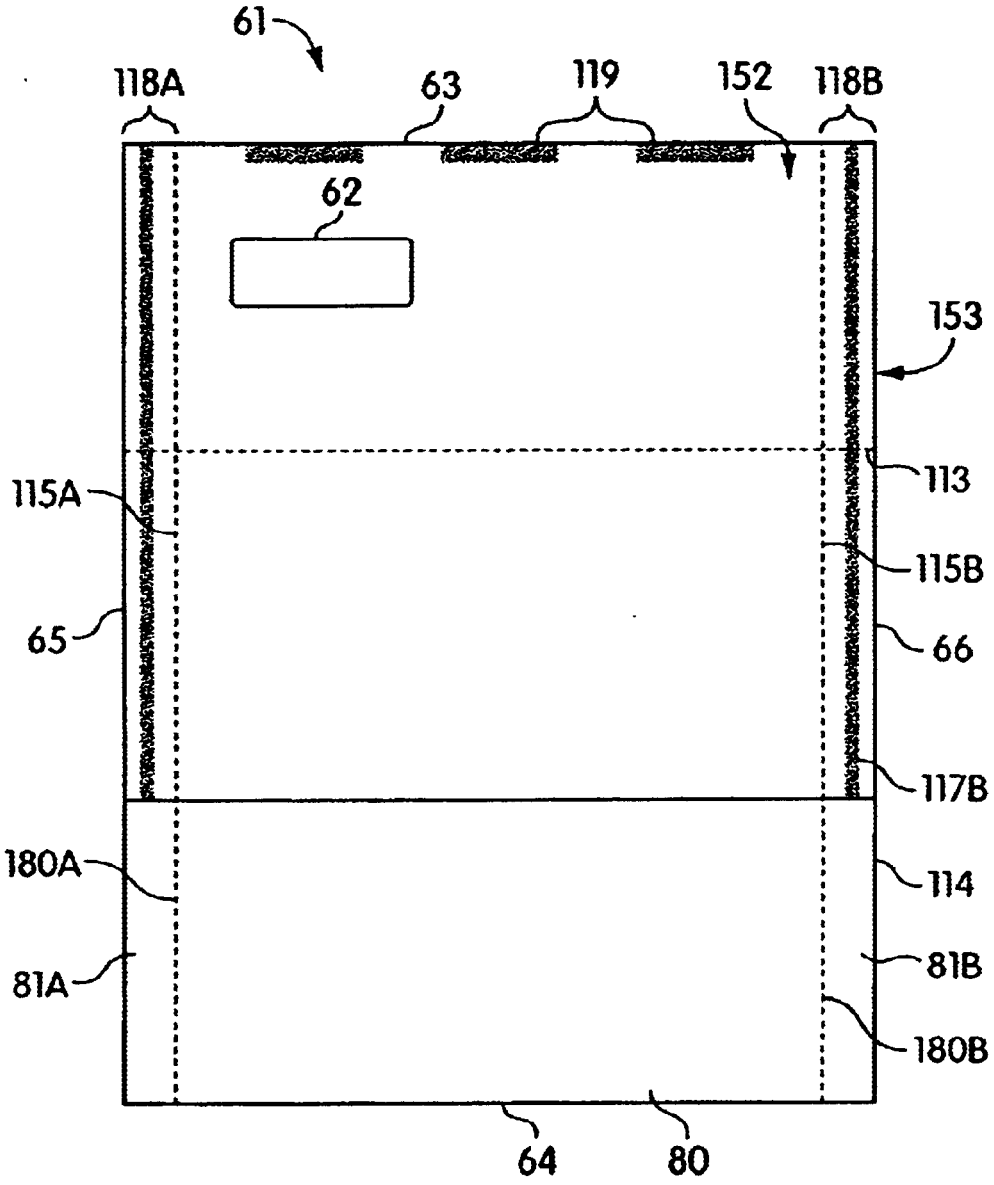
FIG. 11 is a top plan view of a third aspect of the fifth embodiment.

Referring to FIG. 11, a top plan view illustrates a third aspect of the fifth embodiment of the invention providing the one-piece assembly 61 comprising the translucent window 62 and one or more panels or inserts incorporated into the assembly 61. As shown in FIG. 11, the assembly 61 includes a panel or insert 80 that traverses and is incorporated with the front surface 152 of the assembly 61 having a width substantially equivalent to the width of the assembly 61. In one embodiment, the insert 80 may include different overall dimensions than the assembly 61. The insert 80 is adhered to the front surface 152 of the assembly 61 by adhesive (not shown) disposed just inside lines of weakening 180*a*, 180*b*, which may include, although are not limited to, lines of perforations. The lines of weakening 180*a*, 180*b* of the insert 80 extend longitudinally along the first and second side edges 65, 66 of the insert 80 and are coincident with the lines of weakening 115*a*, 115*b* of the assembly 61. The lines of weakening 180*a*, 180*b* of the insert 80 define marginal strips 81*a*, 81*b* that are similarly coincident with the marginal strips 118*a*, 118*b* of the assembly 61. In one embodiment, longitudinal lines of adhesive or cohesive (not shown) may extend along the marginal strips 81*a*, 81*b* of the insert 80 to adhere the insert 80 to the assembly 61 when folded. With the lines of weakening 180*a*, 180*b* of the insert 80 coincident with the lines of weakening 115*a*, 115*b* of the assembly 61, when the marginal strips 118*a*, 118*b* are removed or torn from the assembly 61 when formed, the marginal strips 81*a*, 81*b* of the insert 80 are simultaneously removed to release the insert 80 from the assembly 61.

Figure 12:
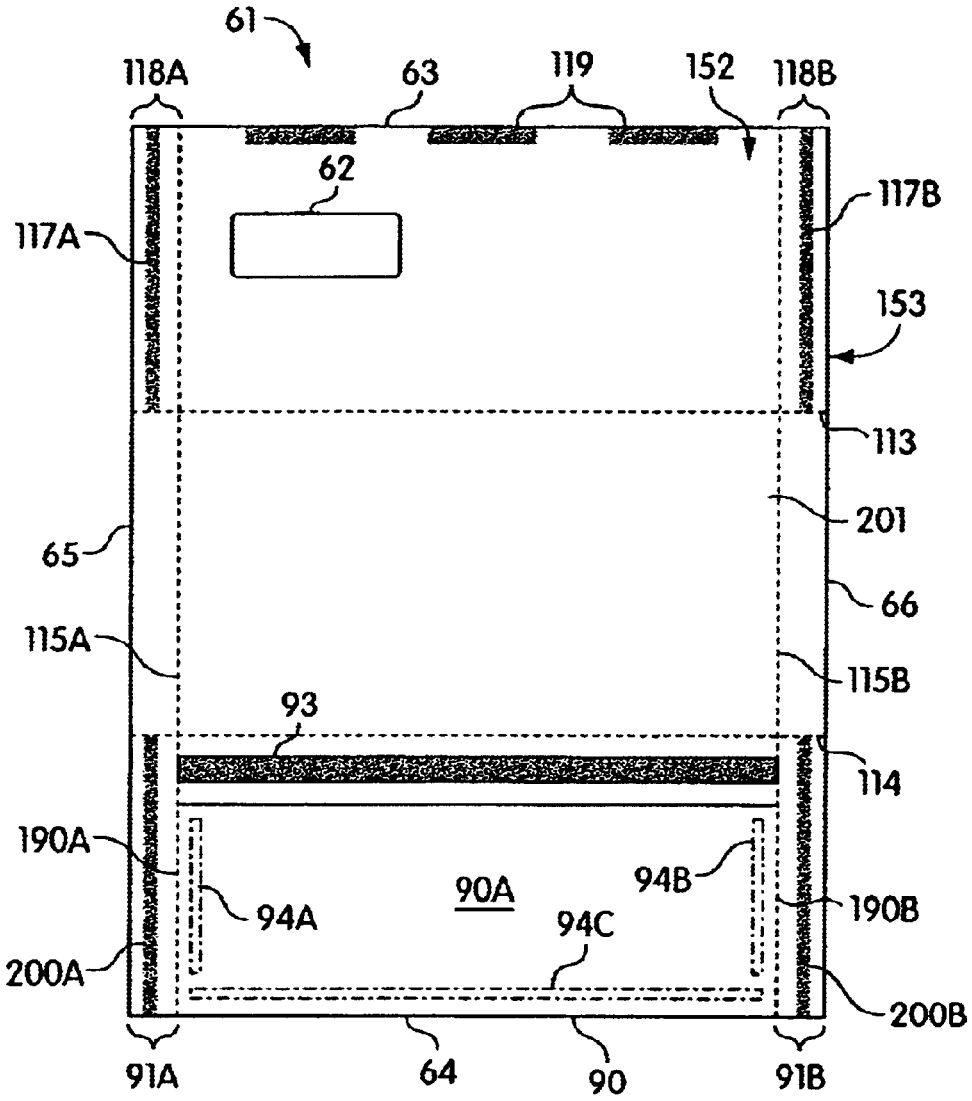
FIG. 12 is a top plan view of a fourth aspect of the fifth embodiment.

Referring to FIG. 12, a top plan view illustrates a fourth aspect of the fifth embodiment of the invention providing the one-piece assembly 61 comprising the translucent window 62 and a return envelope 90. The return envelope 90 includes a panel 90*a* coupled to the front surface 152 of the assembly 61. The panel 90*a* is adhered to the assembly 61 by an adhesive disposed between the panel 90*a* and the front surface 152 as lines of adhesive 94*a*, 94*b* disposed just inside and along lines of weakening 190*a*, 190*b* that extend longitudinally adjacent to the first and second side edges 65, 66. A line of adhesive 94*c* is also disposed just inside and along the bottom edge 64 of the assembly, thereby enabling the panel 90*a* to form a pocket. The return envelope 90 may further include a line of adhesive 93, such as a remoistenable glue, disposed along a width of the panel 90*a* to seal an upper portion of the return envelope 90 when it is removed from the assembly 61 for use.

The lines of weakening 190*a*, 190*b* of the return envelope 90 are coincident with the lines of weakening 115*a*, 115*b* of the assembly 61 and include, although are not limited to, lines of perforations. The lines of weakening 190*a*, 190*b* define marginal strips 91*a*, 91*b* between the lines of weakening 190*a*, 190*b* and the first and second side edges 65, 66. The marginal strips 91*a*, 91*b* include lines of adhesive or cohesive 200*a*, 200*b* disposed between the first and second side edges 65, 66 and the lines of weakening 190*a*, 190*b* to adhere the return envelope 90 to a second panel 201 of the assembly 61 when the assembly is folded. Alternatively, the marginal strips 118*a*, 118*b* of the second panel 201 rather than the marginal strips 91*a*, 91*b* of the panel 90*a* may include adhesive or cohesive to adhere the return envelope 90 to the second panel 201.

Figure 13:
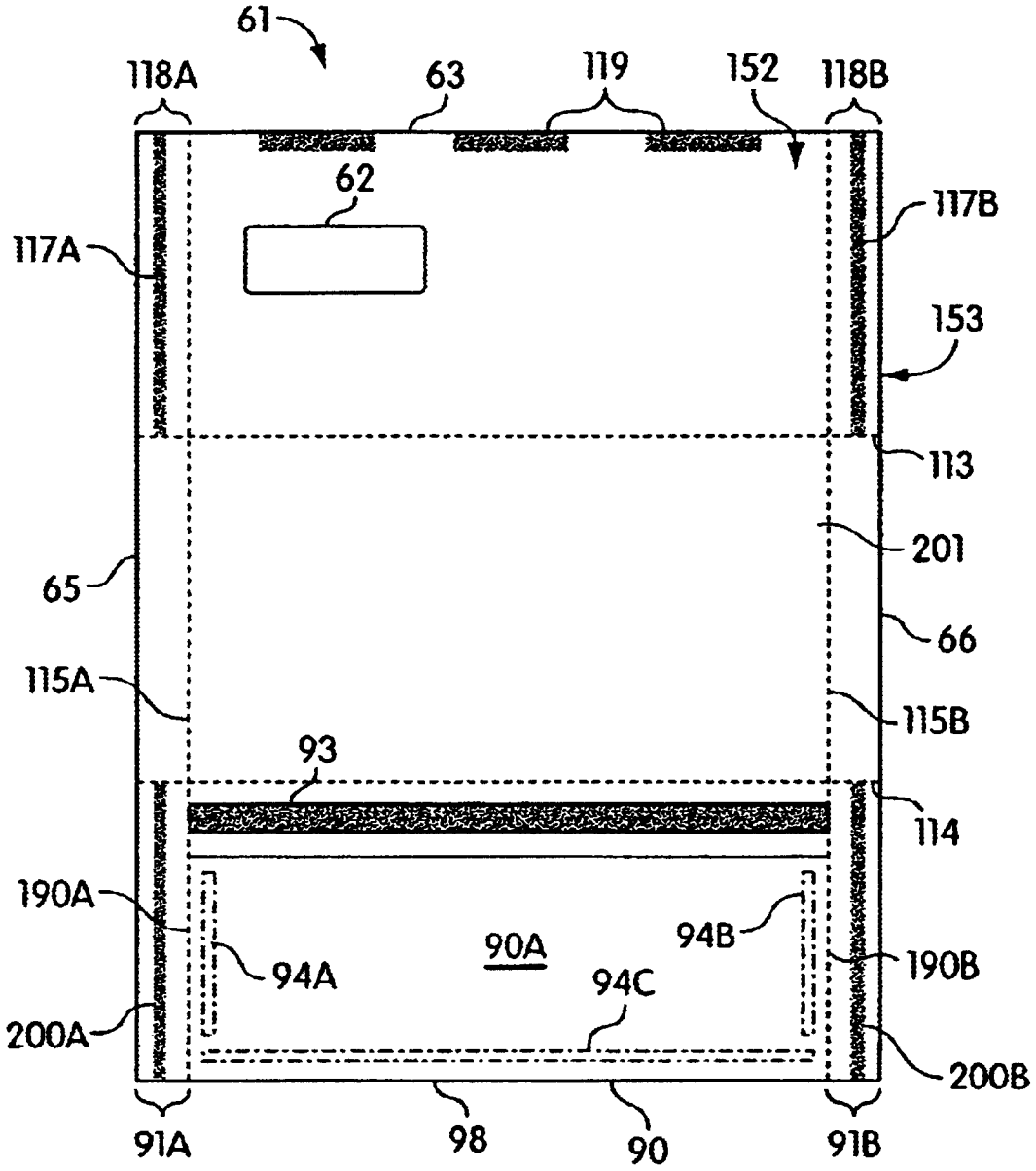
FIG. 13 is a top plan view of the fourth aspect of the fifth embodiment.

Referring to FIG. 13, in one embodiment, the return envelope 90 is formed in the assembly 61 by extending the second panel 201 to a sufficient length such that the second panel 201 is traversely folded along a fold line 98 to form a pocket of the return envelope 90.

Figure 14A:
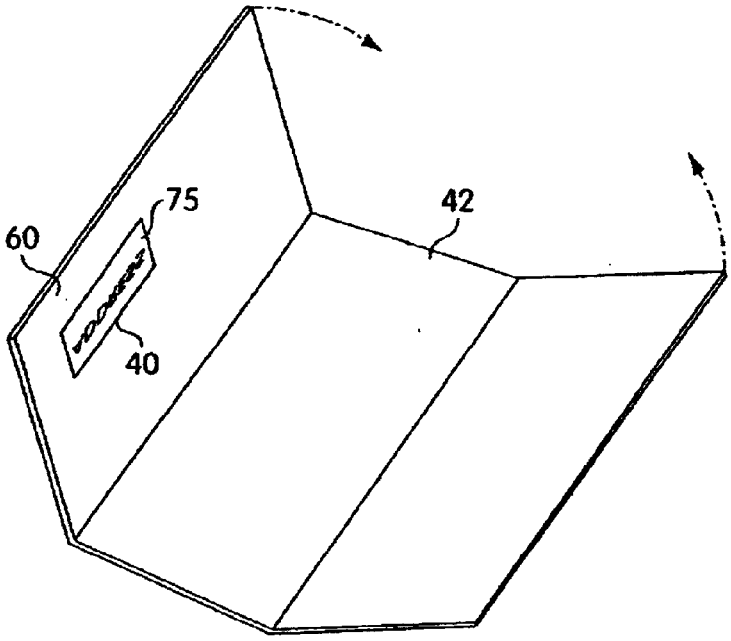
FIG. 14*a* is a perspective view of a fifth aspect of the fifth embodiment illustrating an unfolded one-piece assembly.
Figure 14B:
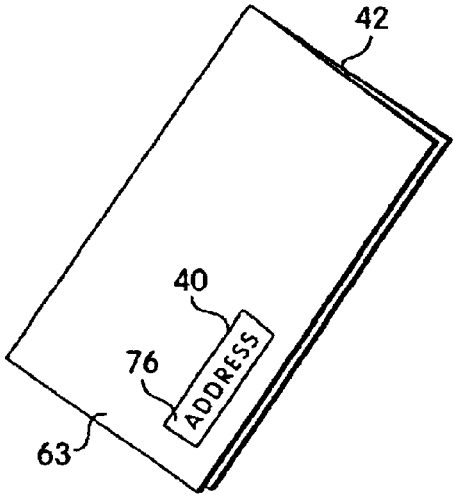
FIG. 14*b* is a perspective view of the fifth aspect of the fifth embodiment illustrating a folded one-piece assembly.

Referring to FIGS. 14*a*–14*b*, a perspective view illustrates a fifth aspect of the fifth embodiment of the invention providing the one-piece paper assembly 42 comprising a translucent area or "window" 40 transparentized according to the method of the invention, as described herein. The translucent window 40 is positioned in the mailer 42 such that when the assembly is traversely folded a panel 60 containing the translucent window 42 is on an outer surface 63 of the assembly 42. Address or other information is printed directly on the translucent window 40 by reverse font imaging, as shown in FIG. 14*a*. Reverse font imaging includes printing information by a laser printer or other suitable printing device in a reverse font format on an inner surface 75 of the translucent window 40. The translucent window 40 has a sufficient clarity such that it permits a mirror image of the information printed in reverse font format to be read from an outer surface 76 of the translucent window once the assembly 42 is formed. Direct printing on the translucent window 40 reduces the amount of surface area of the assembly 42 required to format information and data relative to the position of the translucent window 40 such that adequate viewing of the information through the translucent window 40 is achieved when the assembly 42 is formed. Direct printing on the translucent window 40, in effect, increases the surface area of the assembly 42 available for printing by up to about five percent of the total area of the assembly 42. In addition, direct printing on the translucent window 40 provides a clearer display or image of information or other data. Alternatively, in one embodiment, address or other information may be printed directly onto the assembly 42 at a desired location such that the information can be viewed through the translucent window 40 when the mailer 42 is fully assembled.

Having thus described at least one illustrative embodiment of the invention, various alterations, modifications and improvements will readily occur to those skilled in the art. Such alterations, modifications and improvements are intended to be within the scope and spirit of the invention. Accordingly, the foregoing description is by way of example only and is not intended as limiting. The invention's limit is defined only in the following claims and the equivalents thereto.

What is claimed is:

1. A method of transparentizing a defined area of a paper substrate, the method comprising:

providing the paper substrate having a first surface and a second surface opposite to the first surface, the paper substrate being substantially planar;

providing a first applicator having a surface with a substantially similar area as the defined area of the paper substrate to be transparentized, wherein the defined area is less than an area of the first surface of the paper substrate;

dispensing a first quantity of a transparentizing material to the surface of the applicator;

contacting the surface of the applicator to the first surface of the paper substrate at a desired position of the defined area to apply the first quantity of the transparentizing material and to prevent migration of the transparentizing material beyond the defined area;

exposing the first surface of the paper substrate to a first heat source such that heat produced by the first heat source impinges the transparentizing material to facilitate penetration of the transparentizing material into the paper substrate; and exposing the first surface of the paper substrate to a first source of ultraviolet radiation such that the ultraviolet radiation cures the transparentizing material.

2. The method of claim 1, further comprising applying a second quantity of the transparentizing material to a second surface of the paper substrate opposite to the first surface and along the defined area, and exposing the second surface of the paper substrate to heat supplied by a second heat source to facilitate penetration of the transparentizing material into the paper substrate.

3. The method of claim 2, wherein applying the second quantity of the transparentizing material to the second surface includes applying the second quantity of the transparentizing material to a second applicator having a surface with a substantially similar area as the defined area of the paper substrate, and contacting the second surface with the surface of the second applicator to apply the second quantity of transparentizing material and to prevent migration of the transparentizing material beyond the defined.

4. The method of claim 3, further comprising exposing the second surface of the paper substrate to ultraviolet radiation supplied by a second source of ultraviolet radiation to cure the transparentizing material.

5. The method of claim 1, further comprising heating the first quantity of the transparentizing material prior to dispensing the transparentizing material to the surface of the applicator.

6. The method of claim 1, further comprising embossing a perimeter in the first surface of the paper substrate at the desired position of the defined area before contacting the first surface with the surface of the applicator to prevent migration of the transparentizing material beyond the defined area.

7. The method of claim 1, further comprising exposing the first surface to heat supplied by a second heat source such that heat produced by the second heat source impinges the transparentizing material to facilitate penetration of the transparentizing material into the paper substrate.

8. The method of claim 1, further comprising exposing the first surface to a second source of ultraviolet radiation such that the ultraviolet radiation cures the transparentizing material.

9. The method of claim 1, further comprising controlling a time between exposing the first surface to the first heat source and exposing the first surface to the first source of ultraviolet radiation to facilitate penetration of the transparentizing material into the paper substrate.

10. The method of claim 1, wherein exposing the first surface to heat supplied by the first heat source includes conveying the first surface of the paper substrate past the first heat source.

11. The method of claim 10, wherein conveying the first surface of the paper substrate past the first heat source includes conveying the paper substrate at a rate of conveyance to control a time the first surface is exposed to heat.

12. The method of claim 11, wherein the rate of conveyance includes from about 20 meters per minute to about 250 meters per minute.

13. The method of claim 11, wherein the rate of conveyance is about 70 meters per minute.

14. The method of claim 1, wherein exposing the first surface of the paper substrate to ultraviolet radiation supplied by the first source of ultraviolet radiation includes conveying the paper substrate past the first source of ultraviolet radiation.

15. The method of claim 14, wherein conveying the first surface of the paper substrate past the first source of ultraviolet radiation includes conveying the paper substrate at a rate of conveyance to control a time the first surface is exposed to ultraviolet radiation.

16. The method of claim 15, wherein the rate of conveyance includes from about 20 meters per minute to about 250 meters per minute.

17. The method of claim 1, wherein contacting the surface of the applicator to the the first surface of the paper substrate includes contacting a roller to the first surface, the roller having configured thereon a raised pattern having a substantially planar surface and an area substantially similar to the defined area.

18. The method of claim 6, wherein embossing a perimeter in the first surface of the paper substrate at the desired position of the defined area includes imprinting an embosser to the first surface, the embosser having configured thereon a raised embossing surface, the raised embossing surface defining a perimeter line substantially similar to a perimeter of the defined area.

19. A method of producing a paper substrate with a transparentized window, the method comprising:

providing a paper substrate having a first surface and a second surface opposite to the first surface, the paper substrate being substantially planar;

applying a first quantity of a transparentizing material to a defined area of the first surface of the paper substrate at a desired position, the desired position corresponding to a desired location of the transparentized window in the paper substrate, and the defined area corresponding to a desired size of the transparentized window, wherein the defined area is less than an area of the first surface of paper substrate;

exposing the first surface of the paper substrate to a first heat source such that heat produced by the first heat source impinges the transparentizing material to facilitate penetration of the transparentizing material into the paper substrate; and exposing the first surface of the paper substrate to a first source of ultraviolet radiation such that the ultraviolet radiation cures the transparentizing material.

20. The method of claim 19, wherein applying the first quantity of the transparentizing material to the defined area of the first surface includes contacting a surface of an applicator to the first surface of the paper substrate, the surface of the applicator having a first quantity of the transparentizing material dispensed thereon and defining an area substantially similar to the defined area to limit application of the transparentizing material to the defined area and to prevent migration of the transparentizing material beyond the defined area.

21. The method of claim 12, further comprising embossing a perimeter in the first surface of the paper substrate at the desired position of the transparentized window prior to applying the first quantity of transparentizing material to the defined area to prevent migration of the transparentizing material beyond the defined area.

* * * * *

UNITED STATES PATENT AND TRADEMARK OFFICE

CERTIFICATE OF CORRECTION

PATENT NO. : 6,902,770 B1
DATED : April 27, 2001
INVENTOR(S) : Dulin et al.

It is certified that error appears in the above-identified patent and that said Letters Patent is hereby corrected as shown below:

Column 12,
Line 57, should read -- transparentizing material beyond the defined area".

Signed and Sealed this

Twenty-third Day of August, 2005

JON W. DUDAS
*Director of the United States Patent and Trademark Office*